US007828290B2

(12) United States Patent
Muratani

(10) Patent No.: US 7,828,290 B2
(45) Date of Patent: Nov. 9, 2010

(54) ADU TRANSPORT ROLLER DRIVING DEVICE, IMAGE FORMING APPARATUS, ADU TRANSPORT ROLLER DRIVING METHOD

(75) Inventor: Masataka Muratani, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 520 days.

(21) Appl. No.: 11/844,742

(22) Filed: Aug. 24, 2007

(65) Prior Publication Data

US 2009/0051107 A1 Feb. 26, 2009

(51) Int. Cl.
*B65H 7/00* (2006.01)

(52) U.S. Cl. ..... 271/256; 271/225; 271/264; 271/301

(58) Field of Classification Search ..... 271/256, 271/264, 225, 301
See application file for complete search history.

(56) References Cited

U.S. PATENT DOCUMENTS

| | | | | | |
|---|---|---|---|---|---|
| 4,188,028 | A * | 2/1980 | Miciukiewicz | 271/265.01 |
| 4,792,827 | A * | 12/1988 | Ogura | 399/81 |
| 4,954,847 | A * | 9/1990 | Murata et al. | 399/374 |
| 5,323,219 | A * | 6/1994 | Hamanaka et al. | 399/371 |
| 5,397,107 | A * | 3/1995 | Wolog et al. | 271/10.04 |
| 5,486,910 | A * | 1/1996 | Harada | 399/381 |
| 5,515,150 | A * | 5/1996 | Yoshie et al. | 399/367 |
| 5,755,435 | A * | 5/1998 | Fujiwara | 271/4.04 |
| 5,769,408 | A * | 6/1998 | Selak et al. | 271/10.03 |
| 6,577,844 | B2 * | 6/2003 | Kamei | 399/401 |
| 7,429,040 | B2 * | 9/2008 | Ueda et al. | 271/122 |
| 7,530,568 | B2 * | 5/2009 | Uchida et al. | 271/273 |
| 7,607,658 | B2 * | 10/2009 | Fujiwara | 271/186 |
| 7,621,523 | B2 * | 11/2009 | Ueda et al. | 271/122 |
| 2001/0022422 | A1 * | 9/2001 | Tamura | 271/10.03 |
| 2002/0061215 | A1 * | 5/2002 | Kamei | 399/401 |
| 2003/0038418 | A1 * | 2/2003 | Isemura et al. | 271/10.01 |
| 2006/0290049 | A1 * | 12/2006 | Fujiwara | 271/225 |
| 2008/0211176 | A1 * | 9/2008 | Miura et al. | 271/264 |
| 2008/0315511 | A1 * | 12/2008 | Ueda et al. | 271/258.01 |

FOREIGN PATENT DOCUMENTS

JP 2005-089073 4/2005

* cited by examiner

*Primary Examiner*—Saúl J Rodríguez
*Assistant Examiner*—Howard Sanders
(74) *Attorney, Agent, or Firm*—Turocy & Watson, LLP

(57) ABSTRACT

An ADU transport roller driving device, an image forming apparatus and an ADU transport roller driving method, in which a phenomenon of a warp does not occur on a succeeding sheet, are provided. There are included one drive motor that drives plural transport rollers to transport sheets in an ADU, a first one-way clutch that transmits only rotation force of the drive motor in a forward direction to an entrance side transport roller disposed at an ADU entrance side in a sheet transport direction among the plural transport rollers, a second one-way clutch that transmits only rotation force of the drive motor in a reverse direction of an opposite direction to the forward direction to an exit side transport roller disposed at an ADU exit side in the sheet transport direction among the plural transport rollers, and an electromagnetic clutch capable of transmitting only the rotation force of the drive motor in the forward direction to the exit side transport roller.

14 Claims, 14 Drawing Sheets

FIG. 5

| | ADU MOTOR FORWARD DIRECTION | ADU MOTOR REVERSE DIRECTION | ADU CLUTCH | UPPER TRANSPORT ROLLER ROTATION | MIDDLE TRANSPORT ROLLER, LOWER TRANSPORT ROLLER ROTATION |
|---|---|---|---|---|---|
| STATE 91 | ON | — | ON | ○ | ○ |
| STATE 92 | ON | — | OFF | ○ | — |
| STATE 93 | — | ON | OFF | — | ○ |
| STATE 94 | — | ON | ON | (NOT USED) | |

| | ADU MOTOR | ADU CLUTCH | UPPER TRANSPORT ROLLER ROTATION | MIDDLE TRANSPORT ROLLER ROTATION |
|---|---|---|---|---|
| STATE1 | ON | ON | ○ | ○ |
| STATE2 | ON | OFF | ○ | — |

| | ADU MOTOR FORWARD DIRECTION ROTATION | ADU MOTOR REVERSE DIRECTION ROTATION | ADU CLUTCH | UPPER TRANSPORT ROLLER ROTATION | MIDDLE TRANSPORT ROLLER ROTATION |
|---|---|---|---|---|---|
| STATE A | ON | — | ON | ○ | ○ |
| STATE B | ON | — | OFF | ○ | — |
| STATE C | — | ON | ON | ○ | ○ |
| STATE D | — | ON | OFF | — | ○ |

FIG. (g)

ADU TRANSPORT ROLLER DRIVING DEVICE, IMAGE FORMING APPARATUS, ADU TRANSPORT ROLLER DRIVING METHOD

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

BACKGROUND OF THE INVENTION

1. Field of the Invention

The present invention relates to a driving technique of a transport roller in an ADU in which after one-sided recording is continuously made on plural sheets, the sheets are not stacked but are reversed in the middle of transport, and then, the sheets are again transported to an image forming unit, and recording is made on the second side.

2. Description of the Related Art

Hitherto, as an automatic duplexing unit (hereinafter ADU) transport roller driving device, there is an example (JP-A-2005-89073) in which a first, a second and a third transport rollers are disposed in a re-paper feed transport path, part of the first and the second transport rollers are drive-coupled through one-way clutches to one motor capable of forwardly and reversely rotating, the other end of the first transport roller is drive-coupled to the other ends of the second and the third transport rollers through one-way clutches so that they are mutually rotated in the same direction, and when the motor is forwardly rotated, all the transport rollers are rotation-driven in a sheet transport direction, and when the motor is reversely rotated, only the first transport roller is rotation-driven in the sheet transport direction, and the second and the third transport rollers are stopped.

In the case of the structure as stated above, for example, in the case where the waiting time of a sheet at a registration roller becomes longer than usual because the amount of writing of images on a photoconductive drum is larger than usual, the second and the third transport rollers are stopped, and only the first transport roller is rotation-driven, so that only a succeeding sheet can be transported. However, even if a warp occurs on the succeeding sheet between the first and the second transport rollers during this operation, since switching is performed only between two patterns, that is, all the transport rollers are rotation-driven or only the first transport roller is rotation-driven, and the warp on the succeeding sheet can not be removed.

SUMMARY OF THE INVENTION

An embodiment of the invention has an object to provide a technique capable of realizing three patterns of rotation driving of transport rollers, that is, rotation driving of all transport rollers in an ADU, rotation driving of only a transport roller at an entrance side disposed at an upstream side, and rotation driving of only a transport roller at an exit side disposed at a downstream side.

In order to solve the problem, an ADU transport roller driving device of the invention includes one drive motor that drives plural transport rollers to transport sheets in an ADU, a first one-way clutch that transmits only rotation force of the drive motor in a forward direction to an entrance side transport roller disposed at an ADU entrance side in a sheet transport direction among the plural transport rollers, a second one-way clutch that transmits only rotation force of the drive motor in a reverse direction of an opposite direction to the forward direction to an exit side transport roller disposed at an ADU exit side in the sheet transport direction among the plural transport rollers, and an electromagnetic clutch capable of transmitting only the rotation force of the drive motor in the forward direction to the exit side transport roller.

Besides, an image forming apparatus of the invention includes an ADU transport roller driving device as recited in claim 1 and an image forming unit to form an image on a sheet transported by the ADU transport roller driving device.

Besides, an ADU transport roller driving method includes a first step of rotation-driving an entrance side transport roller disposed at an entrance side in a sheet transport direction among plural transport rollers coupled to a drive motor through a first one-way clutch which can transmit only rotation force in a forward direction by rotation-driving the drive motor in the forward direction and rotation-driving an exit side transport roller disposed at an exit side in the sheet transport direction among the plural transport rollers by coupling an electromagnetic clutch capable of transmitting only the rotation force in the forward direction at a time of coupling, a second step of rotation-driving only the entrance side roller by rotation-driving the drive motor in the forward direction and by releasing the electromagnetic clutch, and a third step of rotation-driving only the exit side transport roller through a second one-way clutch capable of transmitting only rotation force of the drive motor in a reverse direction by rotation-driving the drive motor in the reverse direction and by releasing the electromagnetic clutch.

DESCRIPTION OF THE DRAWINGS

FIG. 5 is a view showing a drive state of the first embodiment.

DESCRIPTION OF THE EMBODIMENTS

Hereinafter, embodiments of the invention will be described with reference to the drawings.

Figure 1:
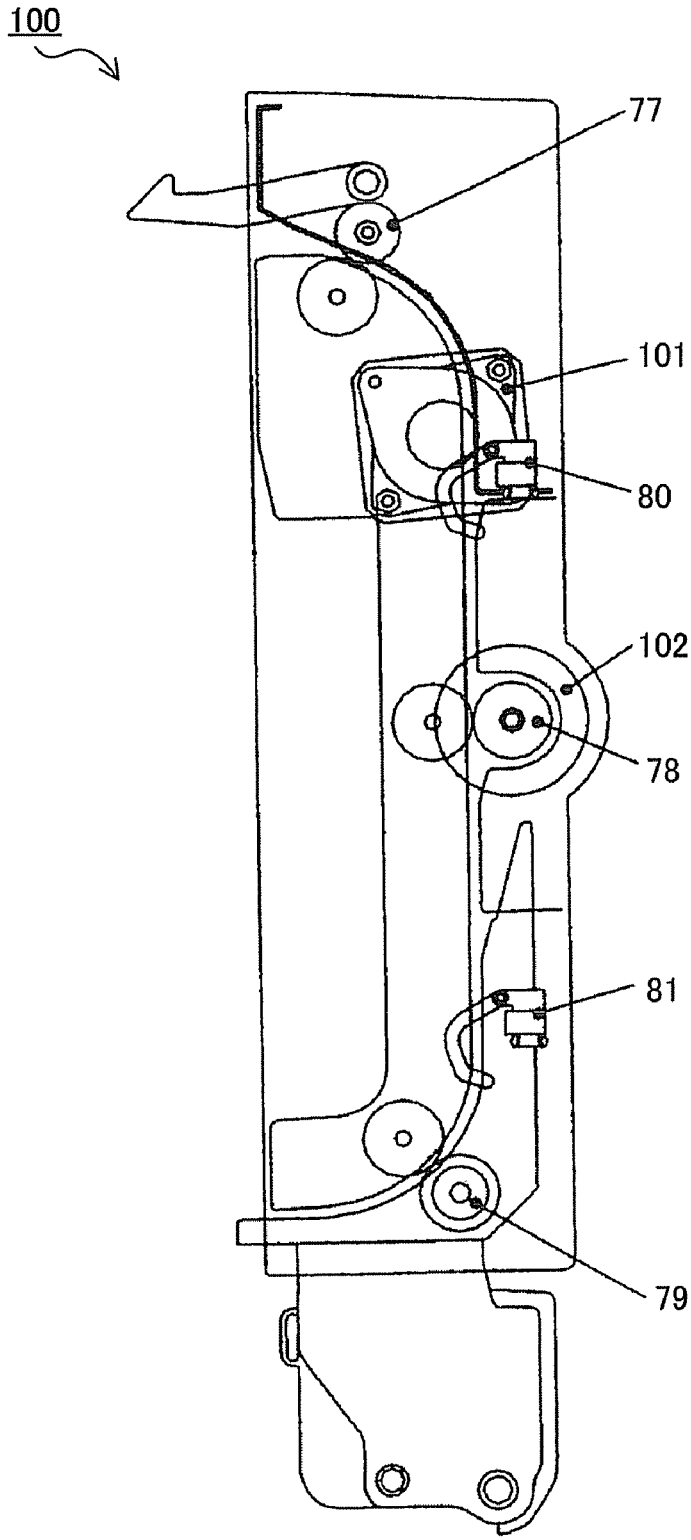
FIG. 1 is a schematic structural view of a stackless ADU.
Figure 2:
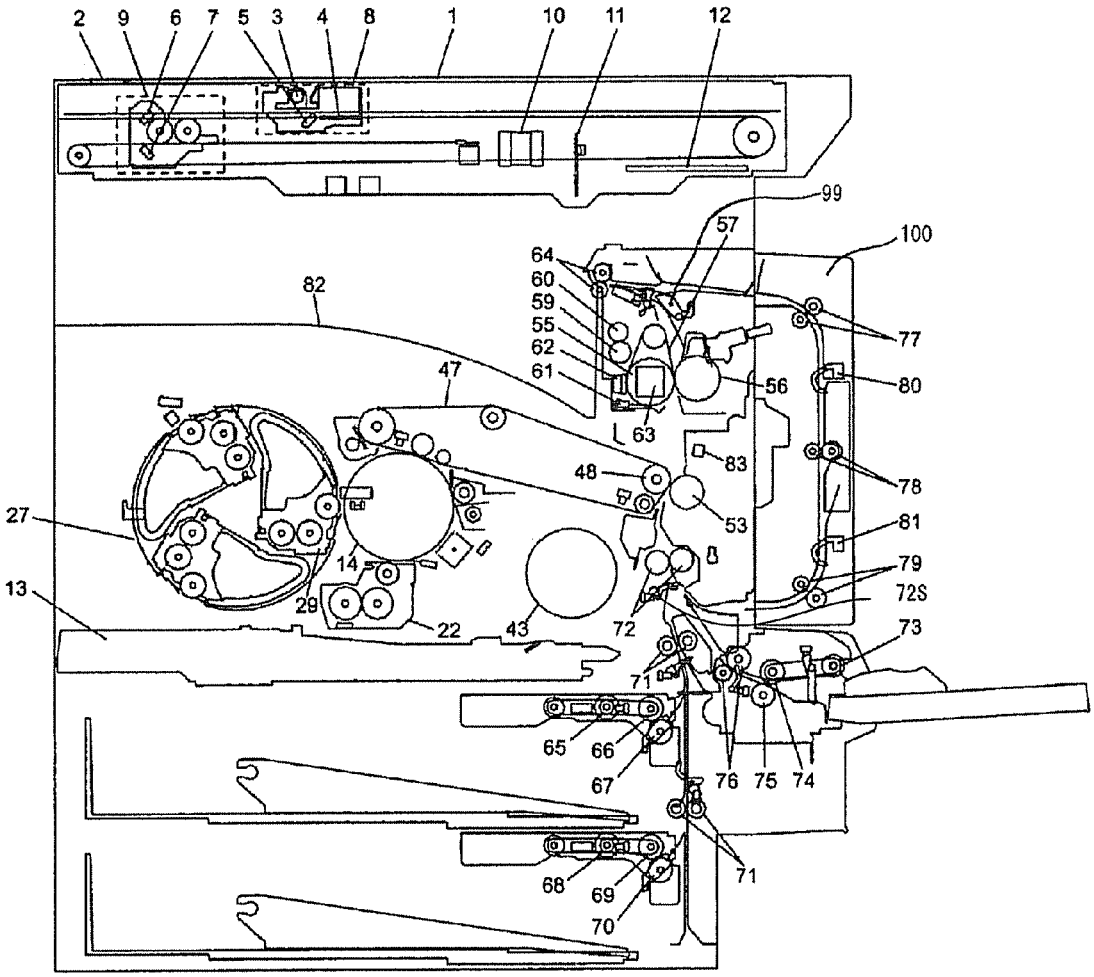
FIG. 2 is a schematic structural view of a digital color copier including the stackless ADU.

FIG. 1 is a schematic structural view of a typical stackless ADU, and FIG. 2 is a schematic structural view of an example of a digital color copier including this ADU.

A structure of the stackless ADU will be described based on FIG. 1.

An ADU motor 101 drives an upper transport roller 77, a middle transport roller 78 and a lower transport roller 79, and an ADU clutch 102 transmits driving of the ADU motor 101 to the middle transport roller 78 and the lower transport roller 79. An ADU carry-in sensor 80 is positioned between the upper transport roller 77 and the middle transport roller 78, and detects a sheet carried into an ADU unit 100, and an ADU carry-out sensor 81 is positioned between the middle transport roller 78 and the lower transport roller 79, and detects a sheet carried out from the ADU unit 100.

Next, a digital color copier including the stackless ADU unit will be described based on FIG. 2.

A main portion constituting the apparatus will be described in brief. The ADU unit 100 is disposed at a side part of an apparatus main body, document read units (scanner units) 1 to 12 to read a set document are disposed at an upper part of the apparatus main body, two stages of cassette paper feed units 65 to 67 and 68 to 70 are disposed at a lower part of the apparatus main body, and manual feed units 73 to 76 to manually feed sheets are disposed below the ADU unit 100 at the side part of the apparatus main body.

An intermediate transport roller 71 for transporting a sheet discharged from the cassette paper feed units 65 to 67 and 68 to 70 is disposed at the downstream side of the cassette paper feed units 65 to 67 and 68 to 70, a registration roller 72 for correcting the inclination of a transported sheet is disposed at the downstream side of the intermediate transport roller 71, and a registration sensor 72S for detecting a sheet is disposed on this side of the registration roller 72. Further, as image forming means, a laser unit 13, a photoconductive drum 14, a revolver unit 27, a black developing unit 22, a transfer belt 47, a secondary transfer roller 53, a heat roller 55, a pressure roller 56, and a fixing belt 57 are respectively disposed. A paper discharge roller 64 for discharging a sheet on which an image is formed and a paper discharge tray 82 on which the discharged sheet is placed are disposed at a further downstream side of the image forming means. A reverse gate 99 for reversing the transport direction of a sheet is disposed on this side and at the upstream side of the paper discharge roller 64.

First Embodiment

Figure 3:
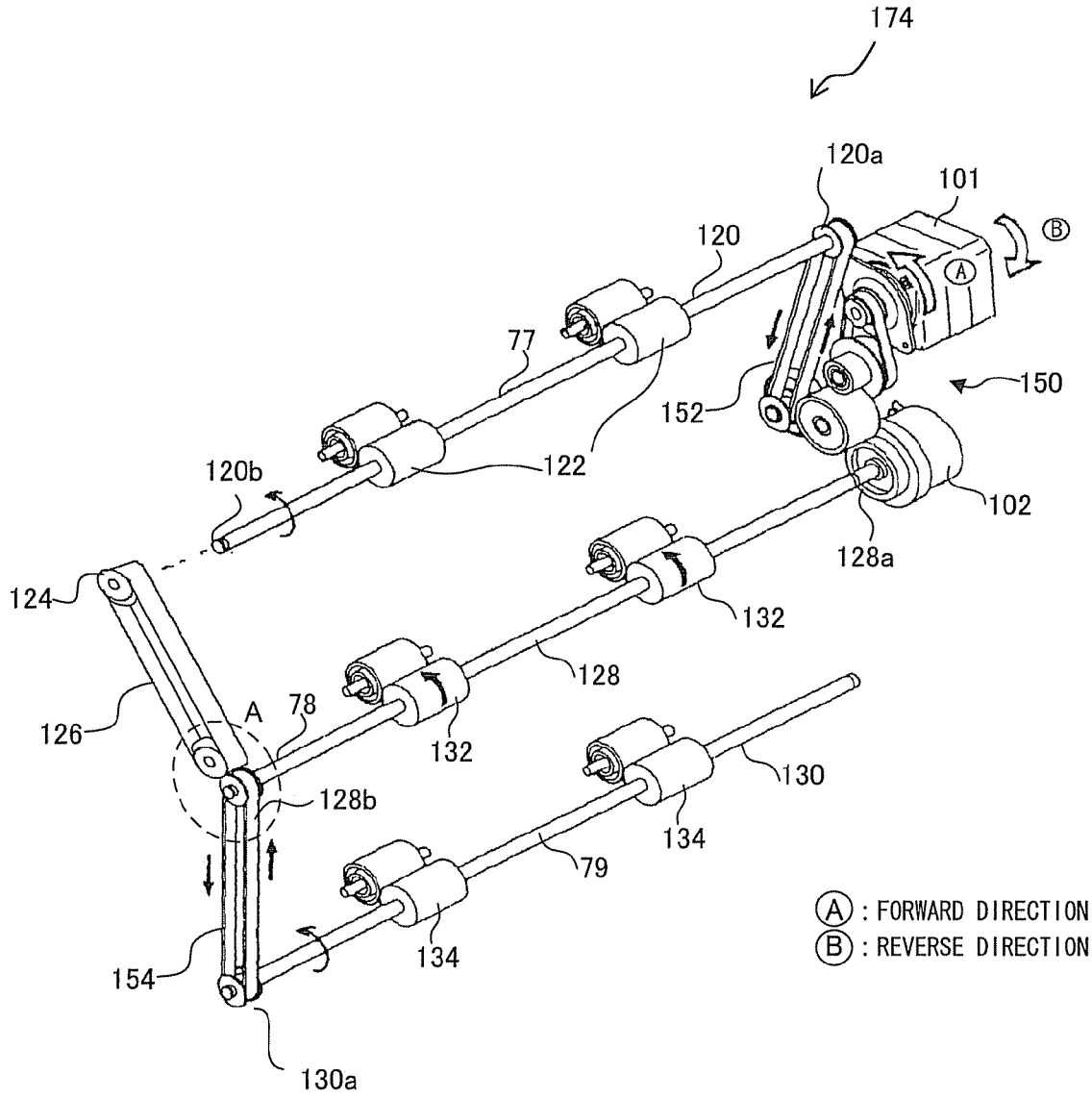
FIG. 3 is a schematic structural view of an ADU transport roller driving device of a first embodiment.
Figure 4:
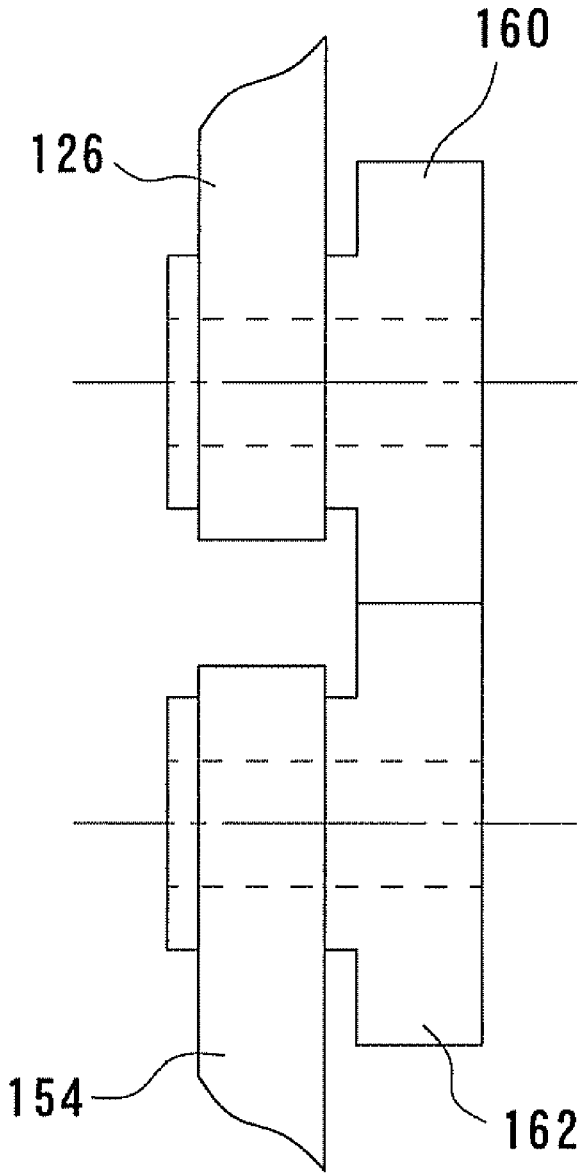
FIG. 4 is an enlarged front view of a portion A of FIG. 3.

FIG. 3 is a schematic structural view of an ADU transport roller driving device 174 of a first embodiment, FIG. 4 is an enlarged front view of a portion A of FIG. 3, and FIG. 5 is a view showing a drive state of the first embodiment.

An upper transport roller (entrance side transport roller) 77 is disposed at the most upstream side in a sheet transport direction in an ADU unit 100, a middle transport roller (exit side transport roller) 78 is disposed at the downstream side of the upper transport roller 77, and a lower transport roller 79 is disposed at the most downstream position, and one end 120*a* of a first drive shaft 120 of the upper transport roller 77 is connected to an ADU motor (drive means) 101 through plural gears 150 and a motor side belt 152 so that rotation in the same direction as that is transmitted.

The first drive shaft 120 supports two first drive rollers 122 made of rubber in an axial direction at a specified interval through a not-shown first one-way clutch (first drive transmission means), and the first one-way clutch is coupled to the first drive shaft 120 and integrally rotates at the time of rotation in a forward direction, however, at the time of rotation in a reverse direction, it is released from the first drive shaft 120 and runs idle.

The other end 120*b* of the first drive shaft 120 is provided with a second one-way clutch (second drive transmission means) 124 which is coupled to the first drive shaft 120 and integrally rotates at the time of rotation in the reverse direction, however, at the time of rotation in the forward direction, it is released from the first drive shaft 120 and runs idle. A second belt (belt) 126 is stretched between the second one-way clutch 124 and a first pulley gear 160, and the rotation of the second one-way clutch 124 is transmitted to the first pulley gear 160 through the second belt 126.

One end 128*a* of a second drive shaft 128 of the middle transport roller 78 is coupled to the ADU motor 101 through an ADU clutch 102 so that the rotation in the same direction as that is transmitted. Besides, the other end 128*b* of the second drive shaft 128 is provided with a second pulley gear 162 engaging with the first pulley gear 160 so that they are integrally rotated, and the rotation driving of the first drive shaft 120 is transmitted to the second drive shaft 128. A first belt 154 is stretched between the second pulley gear 162 and one end 130*a* of a third drive shaft 130 of the lower transport roller 79, and the rotation of the second pulley gear is transmitted to the third drive shaft 130.

Two second drive rollers 132 and two third drive rollers 134 made of rubber are respectively fixed to the second drive shaft 128 and the third drive shaft 130 of the middle transport roller 78 and the lower transport roller 79 at positions spaced from each other by specified intervals in the axial direction.

Incidentally, the ADU motor 101 is a stepping motor, and the ADU clutch 102 is an electromagnetic clutch (third drive transmission means).

Next, an operation will be described.

As shown in FIG. 5, in the case where the ADU motor 101 is rotation-driven in the forward direction, the first one-way clutch is coupled to the first drive shaft 120, and the second one-way clutch 124 is released from the first drive shaft 120, and accordingly, when the ADU clutch 102 is coupled, all the transport rollers 77, 78 and 79 are rotation-driven in the forward direction (state 91 in the drawing) (first step). On the other hand, the ADU clutch 102 is released, there occurs a state in which only the upper transport roller 77 is rotation-driven, and the middle transport roller 78 and the lower transport roller 79 are stopped (state 92 in the drawing) (second step).

Next, in the case where the ADU motor is rotation-driven in the reverse direction (state 93 in the drawing) (third step), the first one-way clutch is released from the first drive shaft 120, and the second one-way clutch is coupled to the first drive shaft 120, and accordingly, there occurs a state in which the first drive roller 122 runs idle with respect to the first drive shaft 120 and is stopped. On the other hand, the rotation driving of the first drive shaft 120 in the reverse direction rotates the second belt 126 in the reverse direction through the second one-way clutch 124, and the rotation of the first drive shaft 120 in the reverse direction is transmitted to the second drive shaft 128 through the second belt 126, and accordingly, the second drive shaft 128 and the third drive shaft 130 are rotation-driven in the forward direction.

Accordingly, when the ADU motor 101 is rotation-driven in the reverse direction in the state where the ADU clutch 102 is released, there occurs a state in which the middle transport roller 78 and the lower transport roller 79 are rotation-driven in the forward direction, and the upper transport roller 77 is stopped.

Second Embodiment

Figures 6, 7:
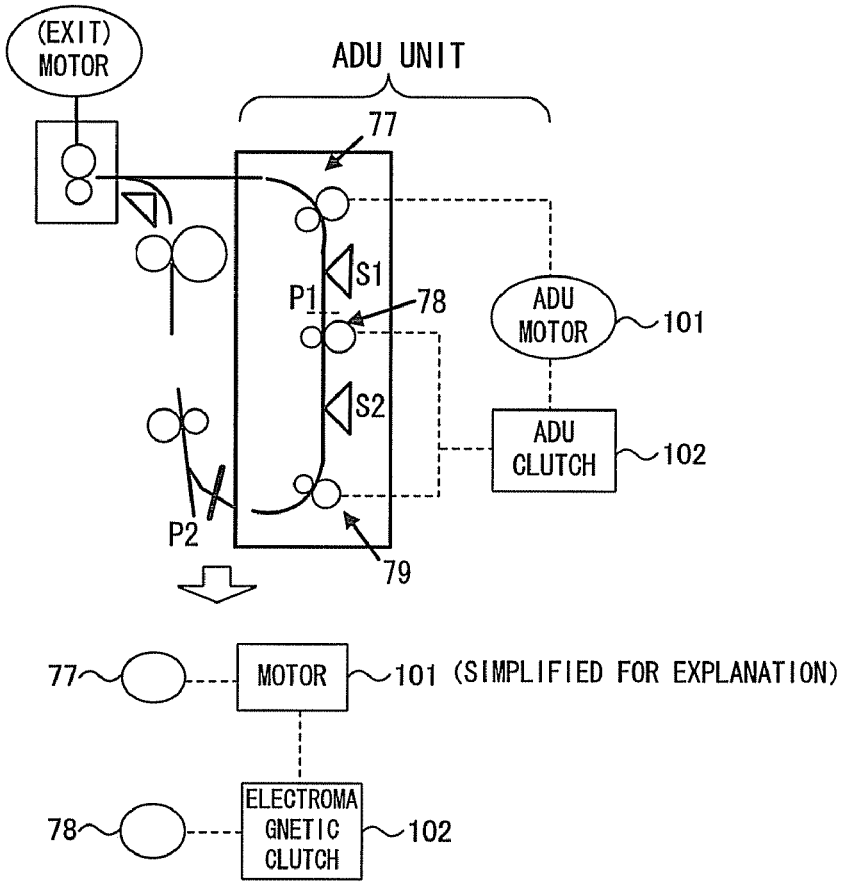
FIG. 6 is a view showing a drive path of a related art ADU.
FIG. 7 is a view showing a drive state of the related art ADU.
Figures 8, 9:
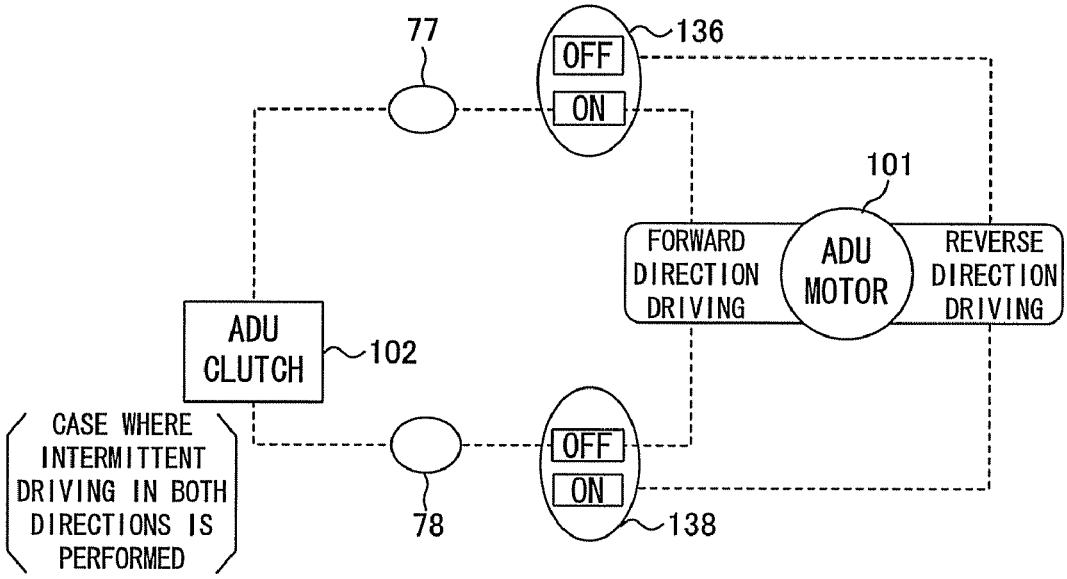
FIG. 8 is a view showing a drive path of an ADU of a second embodiment.
FIG. 9 is a view showing a drive state of the ADU of the second embodiment.

FIG. 6 is an explanatory view of a drive path of related art ADU driving, FIG. 7 is a view showing a related art drive state, FIG. 8 is an explanatory view of a drive path of ADU driving of a second embodiment, and FIG. 9 is a view showing a drive state of the second embodiment. Broken lines in the drawings indicate drive paths.

The gist is that in the case where a single ADU motor and an ADU clutch of one electromagnetic clutch are included as drive means of a stackless ADU unit having plural transport rollers, as shown in FIG. 6, in the related art, an upper transport roller 77 is directly coupled to an ADU motor 101, a middle transport roller 78 and a lower transport roller 79 are coupled to the ADU motor 101 through an ADU clutch 102, and accordingly, as shown in FIG. 7, a driving method is used such that the ADU motor 101 is rotation-driven only in the forward direction, and the coupling and release of the ADU clutch 102 is switched to control rotation driving of all the transport rollers 77, 78 and 79 and rotation driving of only the upper transport roller 77.

On the other hand, as shown in FIG. 8, in the second embodiment, an upper transport roller 77 is coupled to an ADU motor 101 through a one-way clutch 136 which is coupled at the time of rotation driving in the forward direction and is released at the time of rotation driving in the reverse direction, a middle transport roller 78 is coupled to the ADU motor 101 through a one-way clutch 138 which is released at the time of rotation driving in the forward direction and is coupled at the time of rotation driving in the reverse direction, and the upper transport roller 77 and the middle transport roller 78 are coupled to each other through an ADU clutch 102.

Thus, as shown in FIG. 9, when the ADU motor 101 is rotation-driven in the forward direction, since the one-way clutch 136 is coupled and the one-way clutch 138 is released, the power of the ADU motor 101 is transmitted to only the upper transport roller 77, and when the ADU clutch 102 is coupled, the power of the upper transport roller 77 is transmitted to the middle transport roller 78, both the transport rollers 77 and 78 are rotation-driven (state A in the drawing), and when the ADU clutch 102 is released, the transmission of the power between both the transport rollers 77 and 78 is cut off, and only the upper transport roller 77 is rotation-driven (state B in the drawing).

Besides, when the ADU motor 101 is rotation-driven in the reverse direction, since the one-way clutch 136 is released and the one-way clutch 138 is coupled, the power of the ADU motor 101 is transmitted to only the middle transport roller 78, and when the ADU clutch 102 is coupled, the power of the middle transport roller 78 is transmitted to the lower transport roller 77, both the transport rollers 77 and 78 are rotation-driven (state C in the drawing), and when the ADU clutch 102 is released, the transmission of the power between both the transport rollers 77 and 78 is cut off, and only the middle transport roller 78 is rotation-driven (state D in the drawing). Switching between coupling and release of the ADU clutch 102 can be performed while the ADU motor 101 is being rotation-driven, and rotation driving of only the middle transport roller 78 can be realized as in the state D, and accordingly, at the time of driving from a state where two sheets are stopped in the ADU unit 100, it is possible to avoid a phenomenon in which a succeeding sheet bulges.

As stated above, the plural one-way clutches are added, and the driving system can be realized in which the second drive path is added which becomes effective at the time of rotation in the reverse direction of the motor, and accordingly, at the time of rotation of the motor in the reverse direction, the state in which only the exit side roller of the ADU transport path is driven can be realized.

Besides, according to the invention, it is possible to provide an image forming apparatus including the ADU transport roller driving device explained in the respective embodiments and an image forming unit to form an image on a sheet transported by the ADU transport roller driving device.

Figure 10:
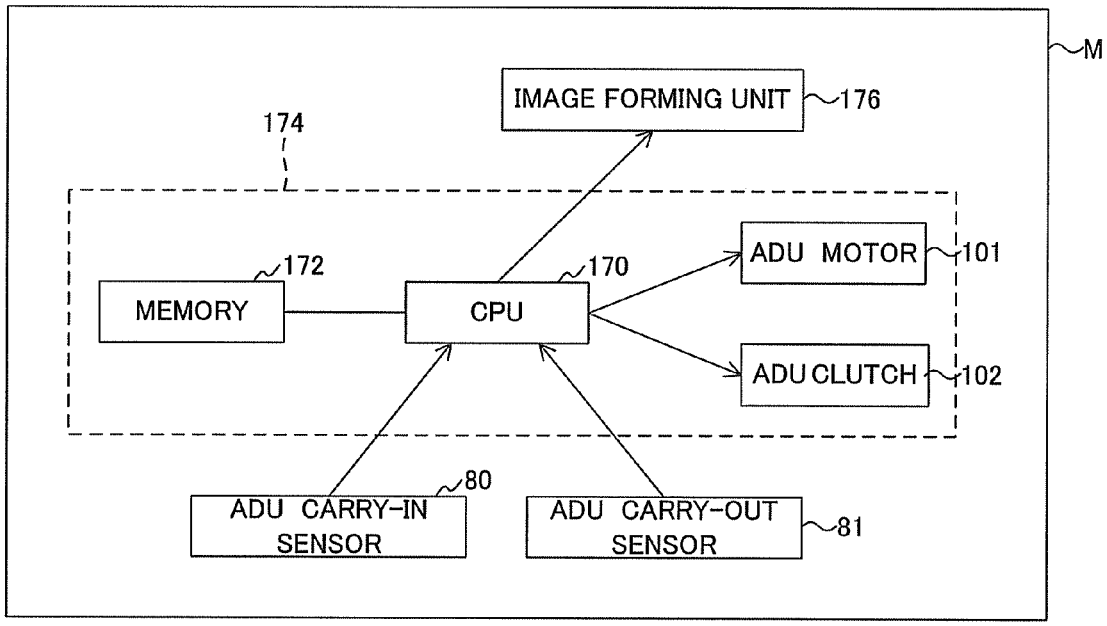
FIG. 10 is a functional block diagram for explaining an image forming apparatus of an embodiment.
Figure 11A:
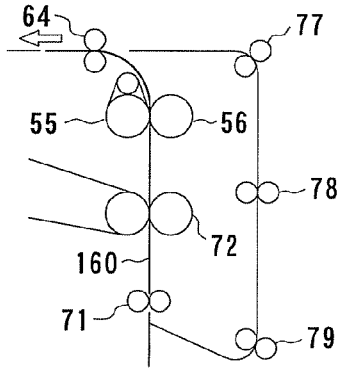
FIG. 11 is an operation explanatory view of one-sheet circulation.
Figure 11B:
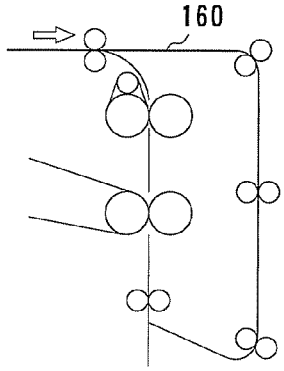
Figure 11C:
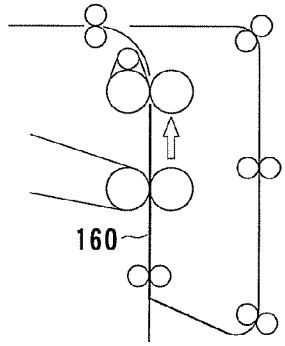
Figure 11D:
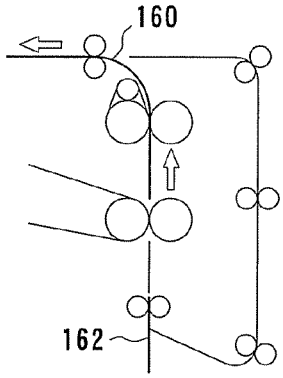
Figure 11E:
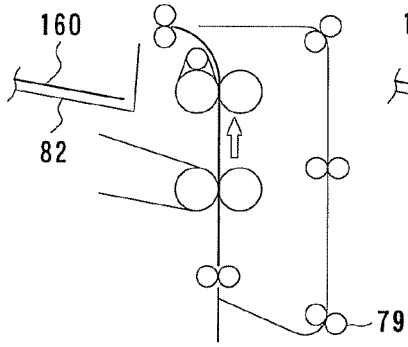
Figure 11F:
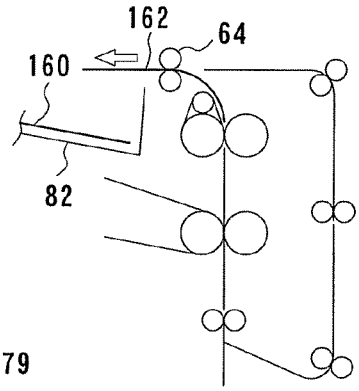
Figure 11G:
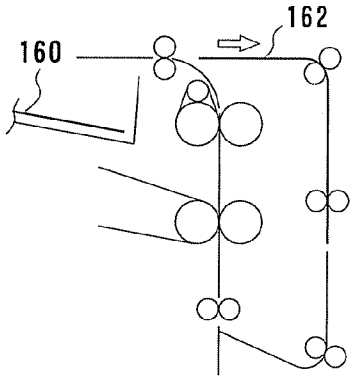
Figure 11H:
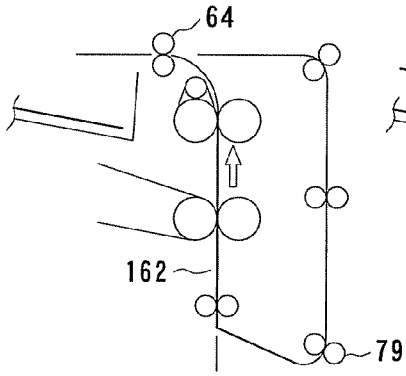
Figure 11I:
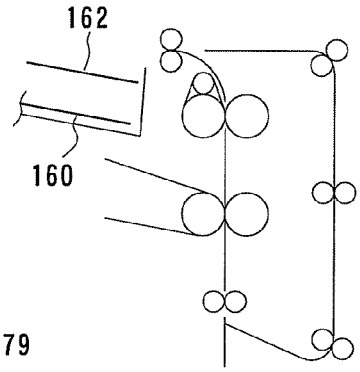

FIG. 10 is a functional block diagram for explaining an ADU transport roller driving device 174 of the embodiment and an image forming apparatus M including this.

The image forming apparatus M of the embodiment includes the ADU transport roller driving device 174, an ADU carry-in sensor 80, an ADU carry-out sensor 81, and an image forming unit 171.

The detection result of the ADU carry-in sensor 80 for a sheet carried into the ADU unit 100 is acquired by a CPU 170. The detection result of the ADU carry-out sensor 81 for a sheet carried out from the ADU unit 100 is acquired by the CPU 170.

The image forming unit 176 forms an image based on instructions from the CPU 170.

The CPU (control unit) 170 has a role of performing various processings in the ADU transport roller driving device 174 and the image forming apparatus M, and has a role of realizing various functions by executing programs stored in a MEMORY 172. The MEMORY 172 includes, for example, a ROM, a RAM or the like, and has a role of storing various information and programs used in the ADU transport roller driving device 174 and the image forming apparatus M. Besides, the CPU 170 has a role of rotation-driving the ADU motor 101 and switching between coupling and release of the ADU clutch 102.

Figure 12:
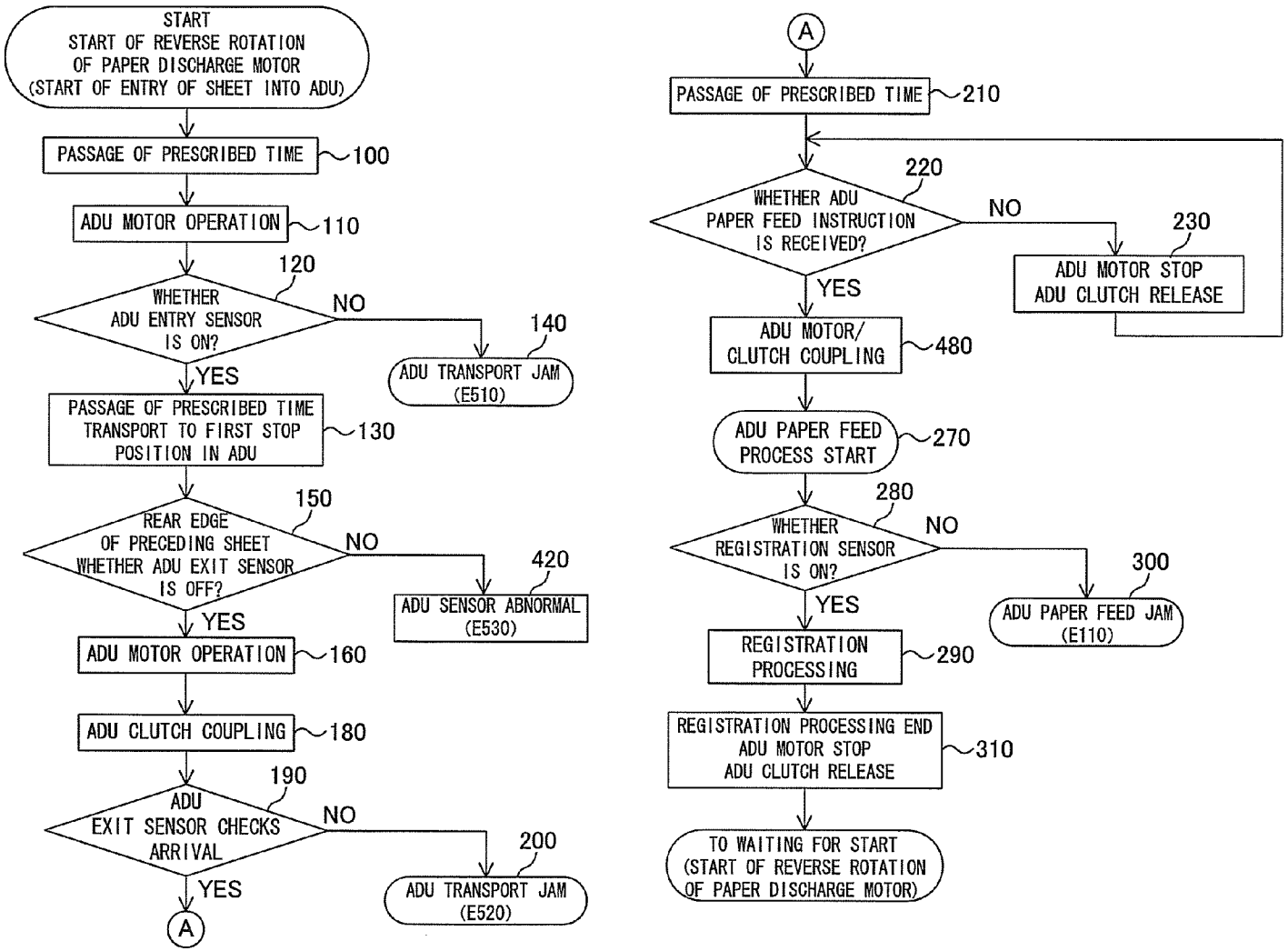
FIG. 12 is an operation flow of the one-sheet circulation.
Figure 13A:
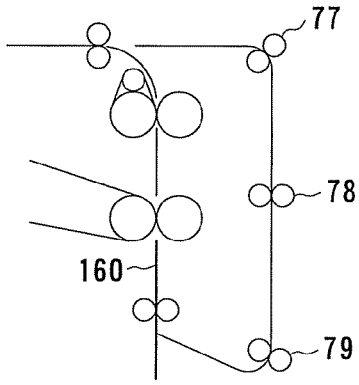
FIG. 13 is an operation explanatory view of two-sheet circulation (in the case of two A4 sheets).
Figure 13B:
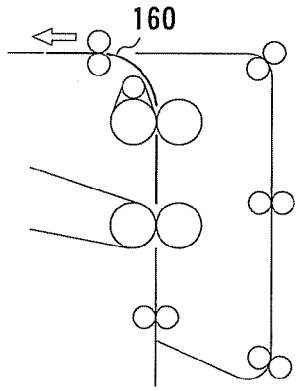
Figure 13C:
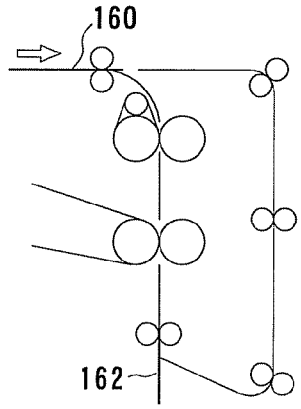
Figure 13D:
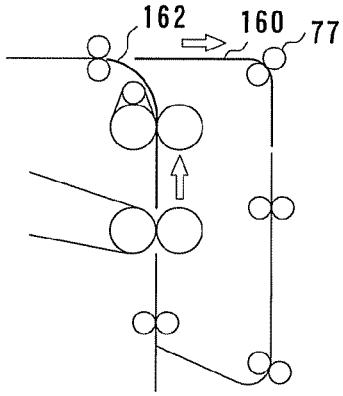
Figure 13E:
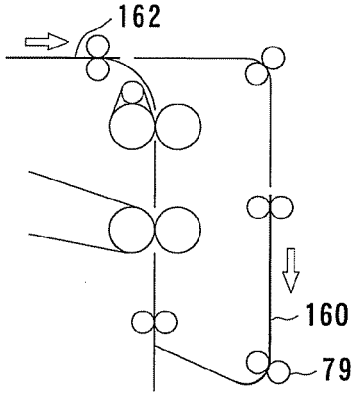
Figure 13F:
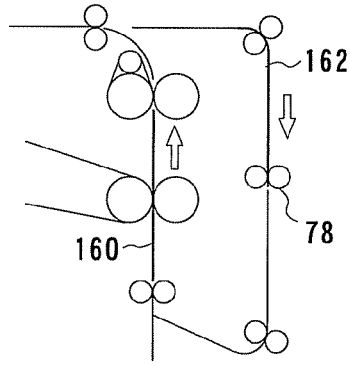
Figure 13F:
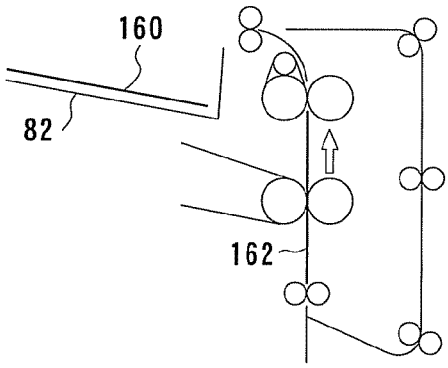
Figure 13H:
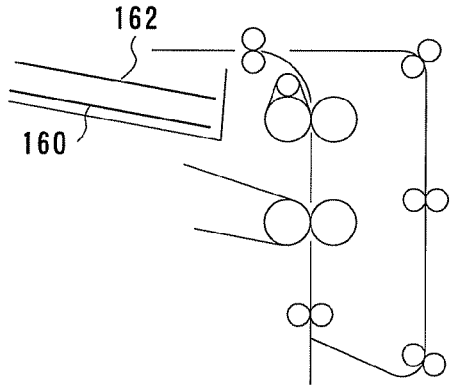
Figure 14A:
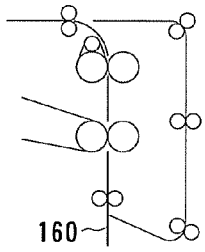
FIG. 14 is an explanatory view of two-sheet first-in alternate circulation (in the case of five A4 sheets).
Figure 14B:
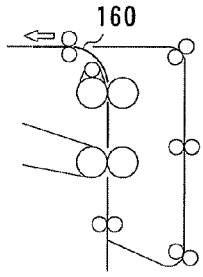
Figure 14C:
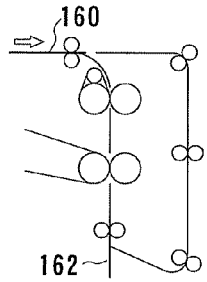
Figure 14D:
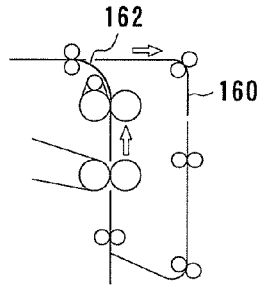
Figure 14E:
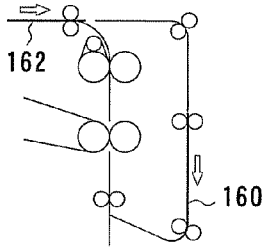
Figure 14F:
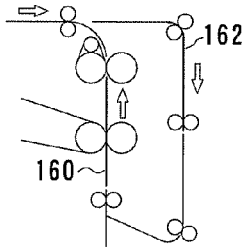
Figure 14G:
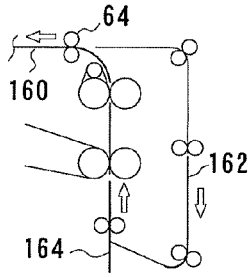
Figure 14H:
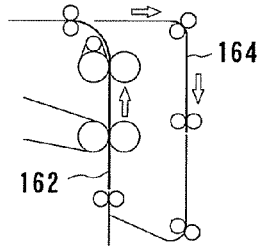
Figure 14I:
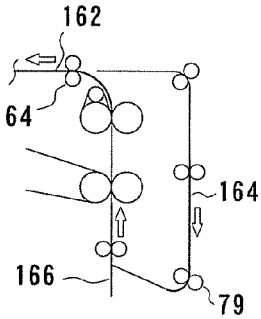
Figure 14J:
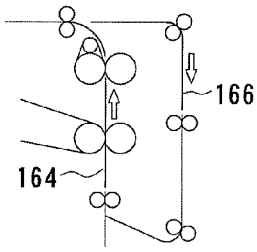
Figure 14K:
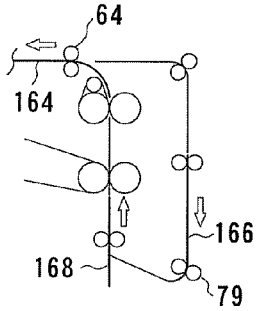
Figure 14L:
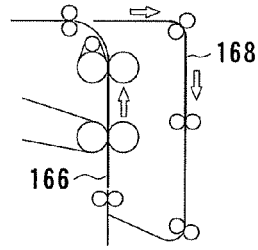
Figure 14M:
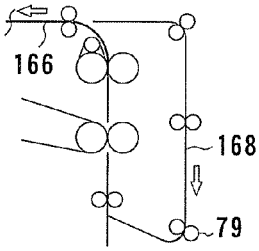
Figure 14N:
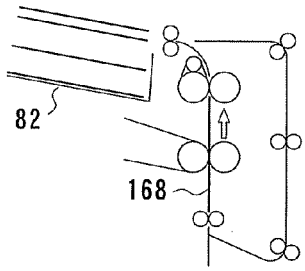
Figure 14O:
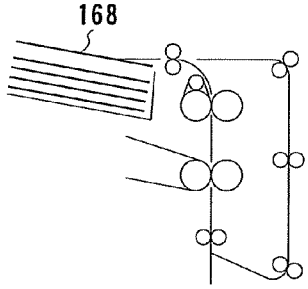

Next, the operation of the ADU in the case of one-sheet circulation according to each of the embodiments will be described with reference to FIG. 11 and FIG. 12. FIG. 11 is an explanatory view of a case where a one-sheet circulation operation is performed, and FIG. 12 is an operation flowchart of the one-sheet circulation.

First, when a double-sided print mode is selected, back side printing (recording of data of the back side) is first performed on a fed sheet 160, and as shown in FIG. 11(*a*), the sheet 160 is transported toward a paper discharge roller 64 direction. When the rear edge of the sheet 160 passes through the reverse gate 99, the sheet 160 is switched back by the paper discharge roller 64, and as shown in FIG. 11(*b*), it is transported into the ADU unit 100 (the reverse gate 99 is switched by its own weight). As shown in FIG. 12, at this time point, the control of the ADU is started, and a prescribed time is measured since the reversal of the sheet 160 (step 100). The switched back sheet 160 is transported at a specified speed, and after the prescribed time has passed, the ADU motor 101 is operated (step 110), the upper transport roller 77 is rotation-driven, and the sheet 160 is transported. Next, it is determined whether the ADU carry-in sensor 80 is on (that is, in the on case, the sheet 160 has reached the position of the ADU carry-in sensor 80) (step 120), and when the ADU carry-in sensor 80 is on, advance is made to step 130, and when it is not on, it is determined that an ADU transport jam occurs, and an error display of E510 is displayed (step 140). Next, at step 130, after the prescribed time has passed, the sheet 160 is transported to a first stop position slightly downstream side of the operation position of the ADU carry-in sensor 80 (fourth step). Next, it is determined whether the ADU carry-out sensor 81 detects the rear edge of the preceding sheet, that is, whether the ADU carry-out sensor 81 is off (step 150), and in the case where it is not detected, the ADU motor 101 is operated (step 160), and in the case where it is detected, an error display of E530 indicating that the ADU carry-out sensor 81 is abnormal is displayed (step 420). After the processing of step 160, the ADU clutch 102 is coupled (step 180), and it is determined whether the ADU carry-out sensor 81 is on (step 190). In the on case, advance is made to step 210, and in the case where it is not on, an error display of E520 indicating an ADU transport jam is displayed. Next, at step 210, the passage of the prescribed time is measured, and next, it is determined whether an ADU paper feed instruction is received (step 220). In the case where it is received, advance is made to step 480, and in the case where it is not received, the ADU motor 101 is stopped and the ADU clutch 102 is released (step 230), and return is made to step 220. At this time, the sheet 160 is transported to a second stop position at a downstream side by a definite distance from the operation position of the ADU carry-out sensor 81, and the sheet is once stopped here and is waiting (fifth step).

Next, when the ADU paper feed instruction is received from a main body control unit, the ADU motor 101 is operated, the ADU clutch 102 is coupled (step 480), and the ADU paper feed processing is started (step 270). The sheet 160 in the waiting state is again transported, and it is determined whether the registration sensor 72S is on (step 280), and in the case where it is on, advance is made to step 290, and in the case where it is not on, an error display of E110 indicating the ADU paper feed jam is displayed (step 300). At step 290, registration processing of the sheet 160 is performed, and next, at the time of end of the registration processing, the ADU motor 101 is stopped and the ADU clutch 102 is released (step 310), and return is made again to the start.

After the resister processing is ended, the sheet 160 sent to the registration roller 72 is subjected to surface printing (data recording of the front side) as shown in FIG. 11(*c*), and as shown in FIG. 11(*d*), the sheet again passes through the lower side of the reverse gate 99, and as shown in FIG. 11(*e*), the sheet is discharged to the paper discharge tray 82, and double-sided printing is completed.

As shown in FIG. 11(*d*), a second sheet 162 is fed when the first sheet 160 passes through the reverse gate 99, and as shown in FIG. 11(*e*), when the first sheet is discharged to the paper discharge tray 82, the back side is printed. Thereafter, similarly to the first sheet 160, as shown in FIG. 11(*f*), the sheet 162 is transported toward the paper discharge roller 64 direction, and when the rear edge of the sheet 162 passes through the reverse gate 99, the sheet is switched back by the paper discharge roller 64, and as shown in FIG. 11(*g*), the sheet is transported into the ADU unit 100. Incidentally, the control at the time when the sheet 162 passes through the ADU unit is the same as that for the sheet 160. After passing through the ADU unit 100, the sheet 162 is subjected to surface printing (data recording of the front side) as shown in FIG. 11(*h*), the sheet passes through the lower side of the reverse gate 99, and as shown in FIG. 11(*i*), the sheet is discharged to the paper discharge tray 82 and the double-sided printing is completed.

Next, the error display will be described.

Jams detected as transport errors on the control include three types, that is, a jam determined based on whether the ADU carry-in sensor 80 is turned on in a definite time after the start of switch back to the inside of the ADU (E510), a jam determined based on whether the ADU carry-out sensor 81 is turned on in a definite time after turning on of the ADU carry-in sensor 80 (E520), and a jam determined based on whether the registration sensor 72S is turned on in a definite time after the start of paper feed operation from the ADU to the main body (E110).

Incidentally, with respect to a sheet larger than the A4/LT size, a print operation of back side→front side is performed for each sheet.

Next, a case where a two-sheet circulation operation is performed on two sheets in the respective embodiments will be described based on FIG. 13. Incidentally, the movement of each sheet proceeds in sequence of from (a) to (h).

First, as shown in FIGS. 13(*a*) and 13(*b*), a first sheet 160 is fed, and after the back side is printed, the sheet passes through the reverse gate 99 and is switched back by the paper discharge roller 64, and the operation until this point is similar to that of the case of the one-sheet circulation. However, the two-sheet circulation is different from the one-sheet circulation, and as shown in FIG. 13(*c*), when the sheet 160 is switched back and is transported into the ADU unit 100, a second sheet 162 is fed.

Thereafter, as shown in FIG. 13(*d*), when the first sheet 160 passes through the upper transport roller 77, the back side printing of the second sheet 162 is ended, and as shown in FIG. 13(*e*), when the sheet 160 reaches the lower transport roller 79, the sheet 162 is switched back and is transported into the AD unit 100.

As shown in FIG. 13(*f*), when the front side of the sheet 160 is printed, the sheet 162 is transported to the middle transport roller 78, and as shown in FIG. 13(*g*), when the sheet 160 is discharged to the paper discharge tray 82, the front side of the sheet 162 is printed. Finally, as shown in FIG. 13(*h*), the sheet 162 is discharged to the paper discharge tray 82.

The order of printing is back of first sheet→back of second sheet→front of first sheet→front of second sheet.

Next, a case where a two-sheet first-in alternate circulation operation is performed in the respective embodiments will be described based on FIG. 14. Incidentally, the movement of each sheet proceeds in the order of from (a) to (o).

Since the operation from FIG. 14(*a*) to FIG. 14(*f*) is similar to the operation of from FIG. 13(*a*) to FIG. 13(*f*) of the two-sheet circulation operation, their explanation will be omitted.

As shown in FIG. 14(*g*), when the first sheet 160 passes through the paper discharge roller 64 and is discharged to the paper discharge tray 82, a third sheet 164 is fed. As shown in FIG. 14(*h*), after the back side of the third sheet 164 is printed, the sheet is switched back by the reverse gate 99, and while the sheet is transported in the ADU unit 100, the front side of the second sheet 162 is printed, and as shown in FIG. 14(*i*), the sheet passes through the paper discharge roller 64 and is discharged to the paper discharge tray 82. At this time, the sheet 164 is discharged from the lower transport roller 79, and a fourth sheet 166 is fed. As shown in FIG. 14(*j*), after the back side of the fourth sheet 166 is printed, the sheet is switched back by the reverse gate 99 and while it is transported in the ADU unit 100, the front side of the third sheet 164 is printed, and as shown in FIG. 14(*k*), the sheet 164 passes through the transport roller 64 and is discharged to the paper discharge tray 82. At this time, the sheet 166 is transported from the lower transport roller 79, and a fifth sheet 168 is fed. As shown in FIG. 14(*l*), after the back side of the fifth sheet 168 is printed, the sheet is switched back by the reverse gate 99, and while it is transported in the ADU unit 100, the front side of the fourth sheet 166 is printed, and as shown in FIG. 14(*m*), the sheet 166 passes through the paper discharge roller 64 and is transported toward the paper discharge tray 82 direction. Thereafter, as shown in FIG. 14(*n*), the fourth sheet 166 is discharged to the paper discharge tray 82, the front side of the fifth sheet 168 is printed, and as shown in FIG. 14(*o*), the fifth sheet 168 passes through the discharge roller 64 and is discharged to the paper discharge tray 82.

The order of printing is back of first sheet (2)→back of second sheet (4)→front of first sheet (1)→back of third sheet (6)→front of second sheet (3)→back of fourth sheet (8)→front of third sheet (5)→back of fifth sheet (10)→front of fourth sheet (7)→back of third sheet (9), and the inside of the bracket indicates a page number.

As stated above, printing is performed such that the first two sides are back→back, the intermediate six sides are front→back→front→back→front→back, and the final two sides are front→front, and accordingly, in the intermediate part, front→back are alternately printed, and a large contribution is made to the improvement of double-sided productivity.

In the operation control of the two-sheet first-in alternate circulation operation, since the ADU paper feed instruction reception is received at a specified timing corresponding to the timing of the completion of image formation operation on the preceding sheet, there occurs a case where an ADU paper feed instruction waiting time becomes relatively long by factors such as a volume of image data processing.

For example, in the case where double-sided original documents of about 30 pages are read by a scanner, a print image with 200% enlargement is required, and the double-sided print operation is started from the completion point of reading of the third page, the print operation catches up with the read operation, and the ADU paper feed instruction waiting time becomes relatively long.

Besides, since the timing of reading of an original document and the timing of transport operation of a sheet are separately controlled, in the case where the entry of a second sheet into the ADU transport path is permitted in the two-sheet circulation, writing to the preceding sheet becomes slow, and in the case where an ADU paper feed instruction is delayed, there can occur a state in which two A4(LT) sheets are stopped in the ADU transport path.

For example, the movement of a sheet at the time when an ADU paper feed instruction is received in a state where two sheets are waiting in the ADU transport path of the case of the related art ADU transport roller driving device shown in FIG. 6 will be described based on FIG. 15.

As shown in FIG. 15(*a*), a preceding sheet 160 is waiting at a second stop position, a succeeding sheet 162 is waiting at a first stop position. It is assumed that a distance from the second stop position to the registration roller is La, and a distance from the first stop position to the middle transport roller 78 is Lb.

First, as shown in FIG. 15(*b*), when the ADU paper feed instruction is received, the ADU motor 101 is operated and the ADU clutch 102 is coupled, the paper feed processing is started, and the leading edge of the preceding sheet reaches the registration sensor 72S (ADU paper feed processing).

Next, as shown in FIG. 15(*c*), after the registration sensor 72S is turned on, the sheet is transported by a specified distance, and the leading edge of the preceding sheet 160 strikes against the registration roller 72, the ADU motor 101 is stopped and the clutch 102 is released (registration processing is ended).

Figure 15A:
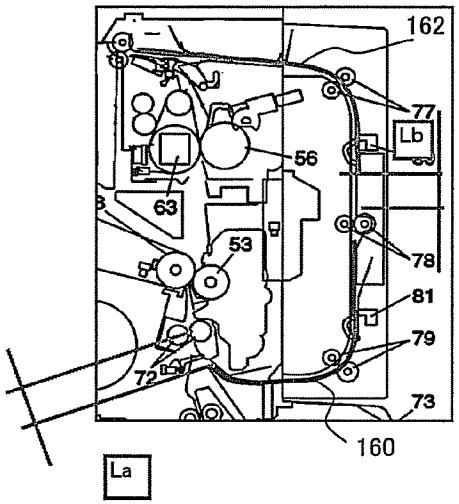
FIG. 15 is an explanatory view of a case where two sheets are waiting in an ADU.
Figure 15B:
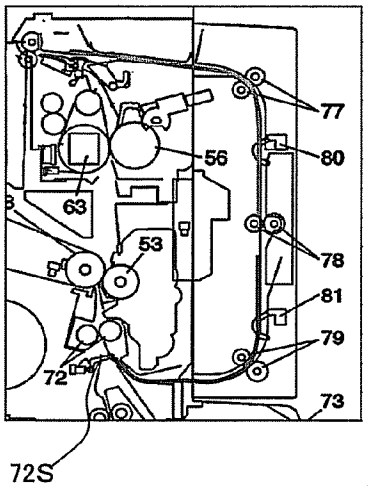
Figure 15C:
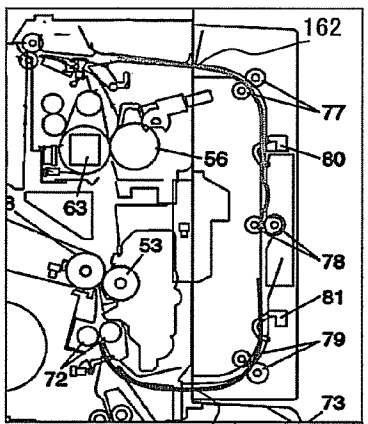
Figure 15D:
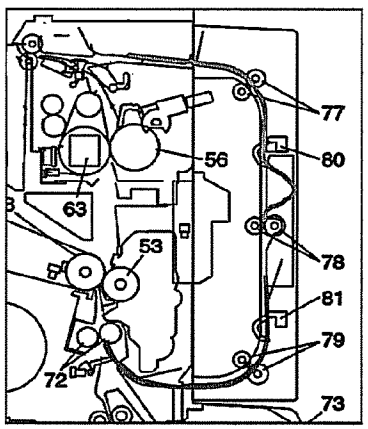

However, in the case of La>Lb, the registration processing of the preceding sheet 160 is ended and when two sheets are stopped, the leading edge of the succeeding sheet 162 reaches the middle transport roller 78. The upper transport roller 77 is stopped by the stop of only the ADU motor 101, and the middle transport roller 78 is stopped by the stop of the ADU motor 101 and the release of the ADU clutch 102, and accordingly, there is a case where the leading edge of the succeeding sheet is bent (bulged) as shown in FIG. 15D because of a difference between the stop time of the ADU motor 101 and the coupling and release time of the ADU clutch 102.

In more detail, in the related art ADU transport roller driving device shown in FIG. 6, the transport of two sheets is performed by switching following states.

(1) When the ADU motor 101 is operated and the ADU clutch 102 is coupled, all the three transport rollers 77, 78 and 79 are rotation-driven.

(2) When the ADU motor 101 is operated and the ADU clutch 102 is released, only the upper transport roller 77 is rotation-driven, and the middle transport roller 78 and the lower transport roller 79 are stopped.

(3) When the ADU motor 101 is stopped, all the three transport rollers 77, 78 and 79 are stopped and the transport is stopped.

Accordingly, in the case where the preceding sheet is fed in the state where two sheets are waiting in the ADU unit 100, it is impossible to stop only the succeeding sheet, and the two sheets are simultaneously transported for a definite distance. The stop in this case (the stop after the registration processing of the preceding sheet) can be performed according to circumstances in two ways, that is, cutting off of coupling of the ADU clutch 102 and speed reduction and stop of the ADU motor 101, however, stop means of the upper transport roller 77 is only the speed reduction and stop of the ADU motor 101.

From the restriction of control of print timing of the two-sheet circulation, in the case where the cutting off of coupling of the ADU clutch 102 is used for the stop after the registration processing of the preceding sheet, when the succeeding sheet is stopped to extend over the upper transport roller 77 and the middle transport roller 78, a time difference occurs in the stop timing of the upper transport roller 77 and the middle transport roller 78 because of a relation of time difference between the stop of the ADU clutch 102 and the stop of the ADU motor 101.

In the case of the stop from high speed transport, this time difference causes a phenomenon of a relative delay of the stop of the ADU motor 101, and there is a possibility of a phenomenon of a warp between rollers at the time of the stop of the succeeding sheet.

On the other hand, in the ADU transport roller driving device of the respective embodiments, the transport of two sheets is performed by switching of three operation:

(1) when the ADU motor 101 is operated and the ADU clutch 102 is coupled, all the three transport rollers 77, 78 and 79 are rotation-driven, (2) when the ADU motor 101 is rotation-driven in the forward direction and the ADU clutch 102 is released, only the upper transport roller 77 is rotation-driven, and the middle transport roller 78 and the lower transport roller 79 are stopped, and (3) when the ADU motor 101 is rotation-driven in the reverse direction and the ADU clutch 102 is released, the upper transport roller 77 is stopped, and the middle transport roller 78 and the lower transport roller 79 are rotation-driven, and accordingly, the phenomenon of the warp between the rollers at the time of the stop of the succeeding sheet is avoided.

Figure 16:
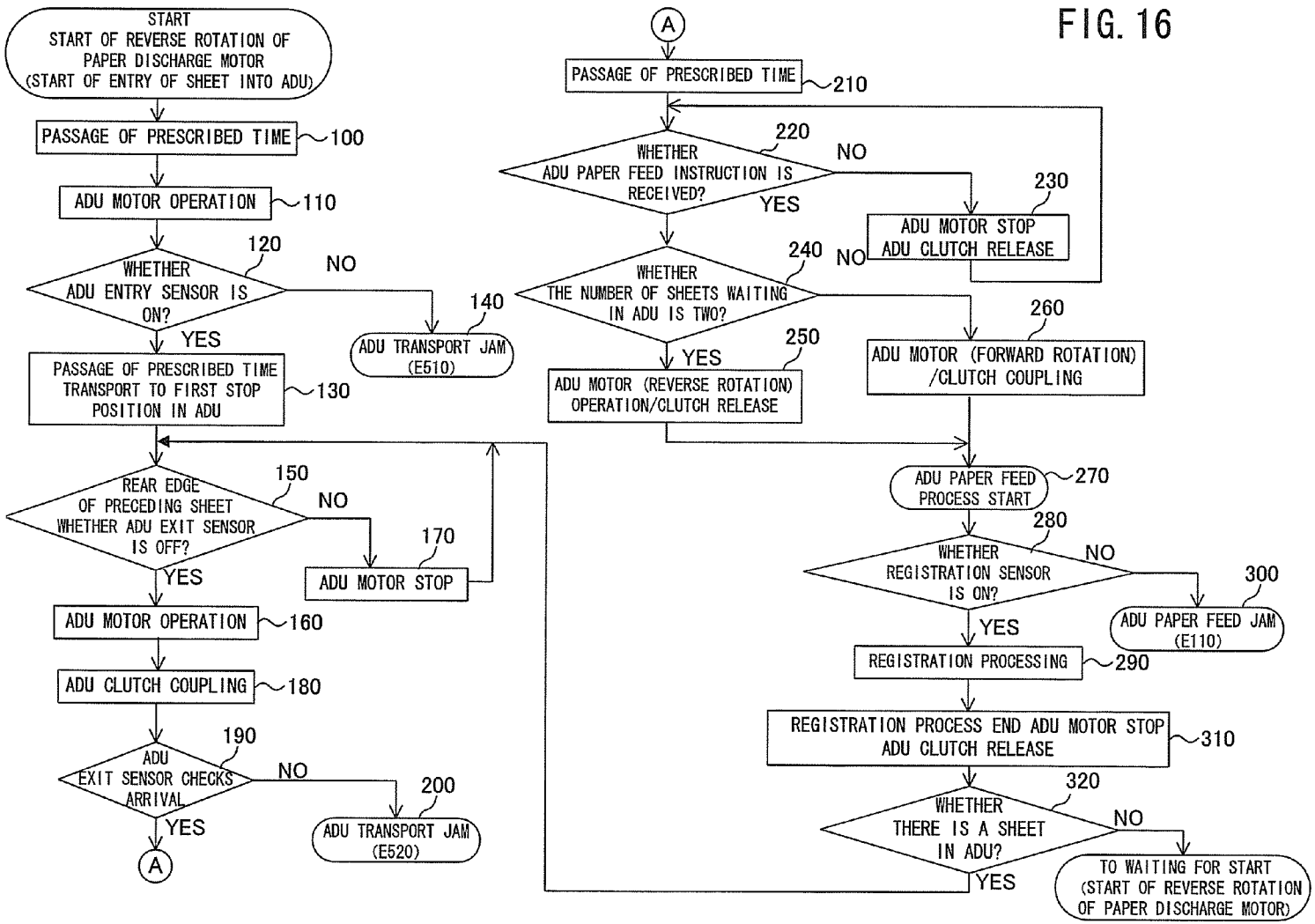
FIG. 16 is an operation flow of the two-sheet first-in alternate circulation.

A more detailed operation will be described based on a flowchart of a two-sheet first-in alternate circulation operation in the respective embodiments shown in FIG. 16. Since the basic operation is similar to the case of the one-sheet circulation described before and shown in FIG. 12, only portions different from FIG. 12 will be described. That is, since step 100 to step 130, step 160 to step 230, and step 270 to step 310 are the same as those of FIG. 8, their description will be omitted. Incidentally, a portion where the same processing as that of FIG. 12 is performed is denoted by the same reference numeral.

At step 150, in the case where the rear edge of a preceding sheet is detected by the ADU carry-out sensor 81 (that is, it is not off), the ADU motor 101 is stopped (step 170), and return is made to step 150. In the off case, similarly to the one-sheet circulation, step 160 is executed.

At step 220, after the ADU paper feed instruction is received, it is determined whether the number of sheets waiting in the ADU unit 100 is two (step 240). When the succeeding sheet does not reach the first stop position, since the determination is NO, the ADU paper feed/registration processing (step 270 to step 310) is executed such that the ADU motor 101 is rotation-driven in the forward direction and the ADU clutch is coupled (step 260) (sixth step). On the other hand, in the case where the succeeding sheet reaches the first stop position, since the determination is YES, in the ADU paper feed/registration processing (step 270 to step 310), the CPU 170 (control unit) rotation-drives the ADU motor 101 in the reverse direction, and releases the ADU clutch (step 250) (seventh step).

Besides, at step 310, at the time of end of the registration processing (the ADU carry-out sensor 81 is turned off), the ADU motor 101 is stopped, and after the ADU clutch 102 is released, it is determined whether there is a sheet in the ADU unit 100 (step 320) based on whether the ADU carry-in sensor 80 is on, and in the case where there is a sheet, return is made to step 150, and the sheet is transported to the second stop position and is waiting. As stated above, even in the state where the preceding sheet remains in the transport path of the ADU, the entry of the succeeding sheet from the ADU transport path entrance is permitted. At step 320, in the case where there is no sheet in the ADU unit 100, the control is ended, there occurs a state of waiting for start, and the paper discharge motor is reversely driven.

Incidentally, at step 130, the subsequent sheet transported to the first stop position (slightly downstream position of the position where the entry sensor is turned on) in the ADU unit 100 can once stop at the first stop position in order not to collide with the preceding sheet, and at step 150, only in the case where the exit sensor 81 is turned off, the sheet is transported to the second stop position (downstream position by a definite distance relative to the position where the leading edge of the sheet turns on the exit sensor 81) and waits for the ADU paper feed instruction.

As described above, in the related art stackless ADU driving, since only the roller at the exit side of the transport path can not be driven among plural transport rollers, at the time of two-sheet circulation, there is a limitation on the execution of the ADU paper feed operation from the state where two sheets are waiting in the ADU transport path. Especially, in the case where the transport speed in the ADU is increased to improve the double-sided productivity, since the possibility that a warp occurs on the succeeding sheet is increased, the necessity of driving of only the exit side becomes high.

On the other hand, in the invention, the single ADU motor remains as it is, and the reverse rotation of the ADU motor is used, so that driving of only the transport roller at the exit side in the transport path can be realized, and accordingly, it becomes possible to transport only the preceding sheet in the state where the succeeding sheet is stopped, and the phenomenon of the warp of the succeeding sheet can be avoided. Besides, since the preceding sheet and the succeeding sheet can be transported separately, it is possible to easily deal with aligning sound, and there is an effect also in the transport of a thick sheet. Further, since it becomes possible to perform functional expansion without adding a motor or an electromagnetic clutch, the cost increase can be suppressed to be relatively low. Besides, the control can be realized by changing only the driving direction of the motor under the specific condition. Besides, since the transport speed of the ADU can be increased, it is especially effective in the case where the double-sided productivity is improved.

The respective steps of the process in the image forming apparatus are realized by causing the CPU 170 to execute ADU transport roller driving programs stored in the MEMORY 172.

In this embodiment, although the description has been given to the case where the function to carry out the invention is previously recorded in the inside of the apparatus, no limitation is made to this, and the same function may be downloaded from a network into the apparatus, or the same function stored on a storage medium may be installed in the apparatus. The form of the recording medium may be any form as long as the recording medium, such as a CD-ROM, can store a program and can be read by the apparatus. Besides, the function obtained by the previous installation or download may realize the function in cooperation with an OS (Operating System) in the apparatus.

Although the invention has been described in detail while using the specific mode, it would be apparent for one of ordinary skill in the art that various modifications and improvements can be made within the sprit and scope of the invention.

According to the structure as stated above, the single ADU motor remains as it is, and the reverse rotation is used, so that the driving of only the transport roller at the exit side in the ADU unit can be realized, and accordingly, it is possible to realize three patterns of rotation driving of the transport rollers, that is, rotation driving of all the transport rollers, rotation driving of only the transport roller at the entrance side disposed at the upstream side, and rotation driving of only the transport roller at the exit side disposed at the downstream side. Accordingly, since only the preceding sheet can be transported in the state where the succeeding sheet is stopped, the phenomenon in which a warp occurs on the succeeding sheet can be avoided.

Besides, since the functional expansion becomes possible without adding a motor or an electromagnetic clutch, the cost increase is relatively small, and the control can be realized by changing only the driving direction of the motor under the specific condition. Further, the invention is particularly effective in the case where the transport speed of the ADU is increased to improve the double-sided productivity.

As described above in detail, according to the invention, it is possible to provide the image forming apparatus including the ADU transport roller driving device described in the above-described respective embodiments and the image forming unit to form an image on a sheet transported by the ADU transport roller driving device.

What is claimed is:

1. An automatic duplexing unit (ADU) transport roller driving device comprising:

one drive motor that drives plural transport rollers to transport sheets in an ADU; a first one-way clutch that transmits only rotation force of the drive motor in a forward direction to an entrance side transport roller disposed at an ADU entrance side in a sheet transport direction among the plural transport rollers;

a second one-way clutch that transmits only rotation force of the drive motor in a reverse direction which is an opposite direction to the forward direction to an exit side transport roller disposed at an ADU exit side in the sheet transport direction among the plural transport rollers; and an electromagnetic clutch capable of transmitting only the rotation force of the drive motor in the forward direction to the exit side transport roller.

2. The ADU transport roller driving device according to claim 1, wherein the drive motor is coupled to transmit power to one end of a first drive shaft of the entrance side transport roller, the first drive shaft supports a first drive roller including the first one-way clutch that is coupled to the first drive shaft to integrally rotate at a time of rotation in the forward direction and is released from the first drive shaft to run idle at a time of rotation in the reverse direction, the other end of the first drive shaft is coupled to a belt through the second one-way clutch that is coupled to the first drive shaft to integrally rotate at a time of rotation in the reverse direction and is released from the first drive shaft to run idle at a time of rotation in the forward direction, and the belt transmits rotation in a reverse direction to a rotation direction of the belt to the exit side transport roller.

3. The ADU transport roller driving device according to claim 2, wherein the belt is stretched between the second one-way clutch and a first pulley gear, and the first pulley gear and a second pulley gear provided to be rotatable in engagement with the exit side transport roller are engaged with each other to transmit rotations in reverse directions to each other.

4. The ADU transport roller driving device according to claim 1, wherein the exit side transport roller is coupled to the entrance side transport roller through the electromagnetic clutch.

5. An image forming apparatus comprising:

an ADU transport roller driving device according to claim 1; and an image forming unit configured to form an image on a sheet transported by the ADU transport roller driving device.

6. The image forming apparatus according to claim 5, further comprising:

an ADU carry-in sensor to detect carrying-in of the sheet into the ADU transport roller driving device;

an ADU carry-out sensor to detect carrying-out of the sheet from the ADU transport roller driving device; and a control unit configured to rotate the drive motor in the reverse direction and to rotation-drive only the exit side transport roller in a case where the ADU carry-in sensor and the ADU carry-out sensor detect that plural sheets exist in the ADU transport roller driving device.

7. An automatic duplexing unit (ADU) transport roller driving device comprising:

one drive means for driving plural transport rollers to transport sheets in an ADU;

first drive transmission means for transmitting only rotation force of the drive means in a forward direction to an entrance side transport roller disposed at an ADU entrance side in a sheet transport direction among the plural transport rollers;

second drive transmission means for transmitting only rotation force of the drive means in a reverse direction which is an opposite direction to the forward direction to an exit side transport roller disposed at an ADU exit side in the sheet transport direction among the plural transport rollers; and third drive transmission means for enabling only the rotation force of the drive means in the forward direction to be transmitted to the exit side transport roller.

8. The ADU transport roller driving device according to claim 7, wherein the drive means is coupled to transmit power to one end of a first drive shaft of the entrance side transport roller, the first drive shaft supports a first drive roller including the first drive transmission means for coupling to the first drive shaft to integrally rotate at a time of rotation in the forward direction and for releasing from the first drive shaft to run idle at a time of rotation in the reverse direction, the other end of the first drive shaft is coupled to a belt through the second drive transmission means for coupling to the first drive shaft to integrally rotate at a time of rotation in the reverse direction and for releasing from the first drive shaft to run idle at a time of rotation in the forward direction, and the belt transmits rotation in a reverse direction to a rotation direction of the belt to the exit side transport roller.

9. The ADU transport roller driving device according to claim 7, wherein the exit side transport roller is coupled to the entrance side transport roller through the third drive transmission means.

10. An image forming apparatus comprising:

an ADU transport roller driving device according to claim 7; and image forming means for forming an image on a sheet transported by the ADU transport roller driving device.

11. The image forming apparatus according to claim 10, further comprising:

ADU carry-in detection means for detecting carrying-in of the sheet into the ADU transport roller driving device;

ADU carry-out detection means for detecting carrying-out of the sheet from the ADU transport roller driving device; and control unit for rotating the drive means in the reverse direction and for rotation-driving only the exit side transport roller in a case where the ADU carry-in sensor and the ADU carry-out sensor detect that plural sheets exist in the ADU transport roller driving device.

12. An automatic duplexing unit (ADU) transport roller driving method comprising:

a first step of rotation-driving an entrance side transport roller disposed at an entrance side in a sheet transport direction among plural transport rollers coupled to a drive motor through a first one-way clutch which can transmit only rotation force in a forward direction by rotation-driving the drive motor in the forward direction and rotation-driving an exit side transport roller disposed at an exit side in the sheet transport direction among the plural transport rollers by coupling an electromagnetic clutch capable of transmitting only the rotation force in the forward direction at a time of coupling;

a second step of rotation-driving only the entrance side roller by rotation-driving the drive motor in the forward direction and by releasing the electromagnetic clutch; and a third step of rotation-driving only the exit side transport roller through a second one-way clutch capable of transmitting only rotation force of the drive motor in a reverse direction by rotation-driving the drive motor in the reverse direction and by releasing the electromagnetic clutch.

13. The ADU transport roller driving method according to claim 12, further comprising:

a fourth step of detecting whether a sheet is waiting at a first stop position which is located at a downstream side of an operation position of an ADU carry-in sensor to detect carrying-in of a sheet into an ADU transport roller driving device;

a fifth step of detecting whether a sheet is waiting at a second stop position which is located at a downstream side of an operation position of an ADU carry-out sensor to detect carrying-out of a sheet from the ADU transport roller driving device, a sixth step of executing the first step in a case where the sheet is not detected at the fourth step and the sheet is detected at the fifth step; and a seventh step of executing the third step in a case where the sheet is detected at both the fourth step and the fifth step.

14. The ADU transport roller driving method according to claim 13, wherein the first stop position is a position of a leading edge of the sheet after the ADU carry-in sensor is operated and after a prescribed time has passed, and the second stop position is a position of a leading edge of the sheet after the ADU carry-out sensor is operated and after a prescribed time has passed.

* * * * *